United States Patent [19]

Skowasch

[11] Patent Number: 4,787,287

[45] Date of Patent: Nov. 29, 1988

[54] AUTOMATIC CANNON HAVING AN AMMUNITION-RECEIVING DEVICE

[75] Inventor: Gerhard Skowasch, Gelsenkirchen, Fed. Rep. of Germany

[73] Assignee: Rheinmetall GmbH, Düsseldorf, Fed. Rep. of Germany

[21] Appl. No.: 54,961

[22] Filed: May 28, 1987

[30] Foreign Application Priority Data

May 30, 1986 [DE] Fed. Rep. of Germany ..... 3618267

[51] Int. Cl.[4] ..... F41F 11/02

[52] U.S. Cl. ..... 89/24; 42/23

[58] Field of Search ..... 42/24, 23; 89/24, 33.05, 89/33.03, 47, 198

[56] References Cited

U.S. PATENT DOCUMENTS

| | | | |
|---|---|---|---|
| 800,021 | 9/1905 | Schneider | 89/47 |
| 811,797 | 2/1906 | Schneider | 89/47 |
| 1,674,370 | 6/1928 | Methlin | 89/24 |
| 2,608,135 | 8/1952 | Aldrin | 89/33.05 |
| 3,276,322 | 10/1966 | Christiansson | 89/33.05 |
| 4,033,227 | 7/1977 | Eklund et al. | 89/47 |
| 4,183,281 | 1/1980 | Hultgren et al. | 89/47 |
| 4,674,215 | 6/1987 | Bierwirth | 89/24 |

FOREIGN PATENT DOCUMENTS

| | | | |
|---|---|---|---|
| 064661A2 | 4/1982 | European Pat. Off. . | |
| 3238893 | 4/1984 | Fed. Rep. of Germany | 89/47 |
| 248237 | 2/1948 | Switzerland | 89/33.05 |

*Primary Examiner*—Harold J. Tudor
*Assistant Examiner*—Stephen Johnson
*Attorney, Agent, or Firm*—Spencer & Frank

[57] ABSTRACT

In an automatic weapon having a wedge-type breech 6, a linearly advancing and retracting feed finger 5 is provided to transport caseless ammunition 4 into the cartridge chamber 10*a* of the gun barrel 10, with the feed finger pushing against the rear face of the powder body 4*a* of the cartridged ammunition 4. An ammunition-receiving device is employed to prevent recoil of the ammunition 4 and consequent damage to the powder body 4*a.* The ammunition-receiving device includes leaf springs 2 which are disposed in the feed opening 3 of the gun housing 1, with the free ends 2*a* of the leaf springs 2 projecting radially inwardly to thus constrict the inner width of the feed opening 3. The free ends 2*a* of leaf springs 2 press on the outer surface of powder body 4*a* of the caseless ammunition and inhibit its forward movement.

7 Claims, 2 Drawing Sheets

AUTOMATIC CANNON HAVING AN AMMUNITION-RECEIVING DEVICE

BACKGROUND OF THE INVENTION

The present invention relates to an automatic cannon having a receiving device for damping the movement of caseless ammunition as it is loaded. More particularly, the invention is directed to a receiving device for use with an automatic cannon of the type having a wedge-type breech, wherein a linearly advanced and retracted feed finger is employed for transporting the caseless ammunition through feed openings in the weapon housing and the breech and into the cartridge chamber of the gun barrel.

In automatic cannons having a wedge-type breech, the ammunition is conveyed into the cartridge chamber of the gun barrel. The cartridge is pushed into the chamber by a feed finger which performs a forward and backward movement. This movement is always accelerated after a reversal of direction and is decelerated before a reversal of direction. When, during the feeding process, the movement of the feed finger is decelerated, the cartridge moves ahead of the feed finger and into the cartridge chamber. The cartridge recoils against the still-advancing feed finger and is pushed back by the finger into the cartridge chamber. With cartridge ammunition this does not result in malfunctions because the cartridge case is easily able to withstand the resulting mechanical stresses. The situation is different for caseless ammunition. If the recoiling ammunition hits against the advancing feed finger, the powder of the ammunition will break off to a greater or lesser degree in the impact area. The still-advancing feed finger is then no longer able to push the cartridge completely into the cartridge chamber. Accordingly, the part of the powder body of the caseless ammunition which projects from the cartridge chamber may be sheared off by the wedge-type breech as it closes. This may cause dangerous ignition of the ammunition outside the weapon.

SUMMARY OF THE INVENTION

It is an object of the invention to provide a receiving device for caseless ammunition which avoids sudden impact of the ammunition introduced into the cartridge chamber of the weapon.

This object is accomplished by providing a receiving device having means for damping the forward movement of the ammunition as it enters the weapon.

DESCRIPTION OF THE PREFERRED EMBODIMENTS

The invention is based on the realization that, during the feeding of caseless ammunition 4, its disadvantageous recoil can be prevented by suitable damping means. Two embodiments of a receiving device which inhibits recoil when the ammunition 4 is loaded into an automatic cannon will be discussed below.

Figure 2:
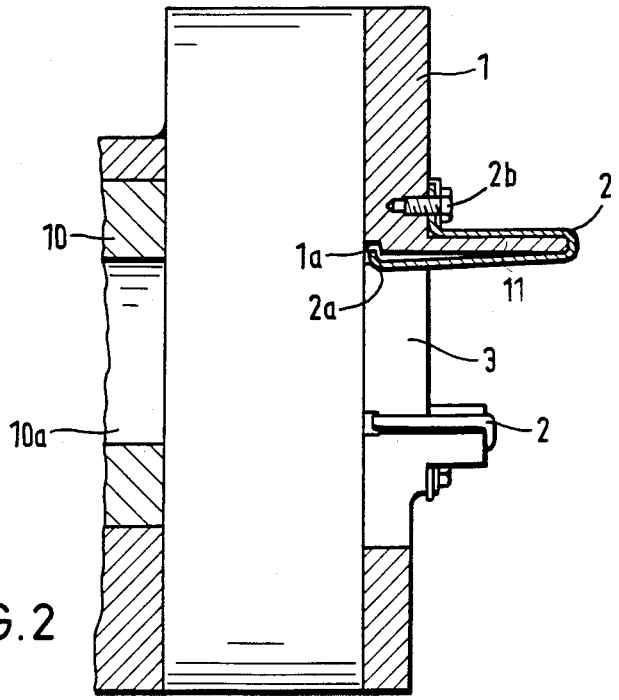
FIG. 2 is a longitudinal sectional view of the weapon housing seen along line 2—2 of FIG. 1.
Figure 3:
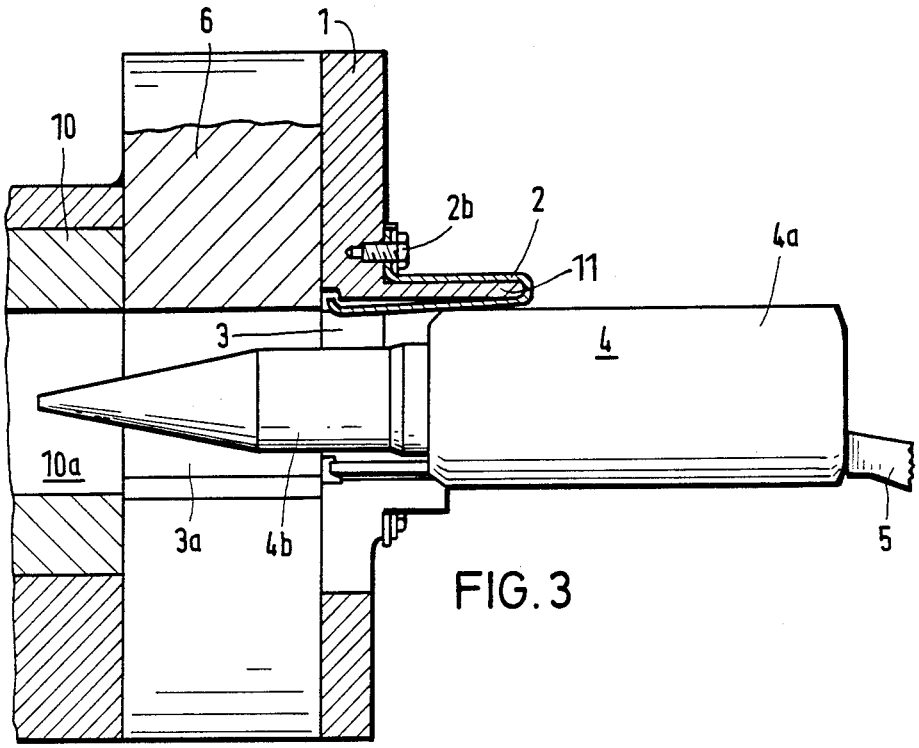
FIG. 3 is a longitudinal sectional view of the weapon housing along line 2—2 of FIG. 1, with an inserted caseless piece of ammunition being additionally shown.

In the first embodiment of the invention (see FIGS. 1–3), leaf springs 2 are provided in the rear portion of weapon housing 1 for damping the forward movement of caseless ammunition 4. The free front ends 2*a* of leaf springs 2 project into the feed path for caseless ammunition 4 and thus constrict the feed opening 3 for the ammunition 4. The leaf springs 2 extend around corresponding bracing fingers 11, which extend outward from the rear side of weapon housing 1 and provide internal supports which prevent leaf springs 2 from being permanently deformed should some object accidentally strike them.

Figure 1:
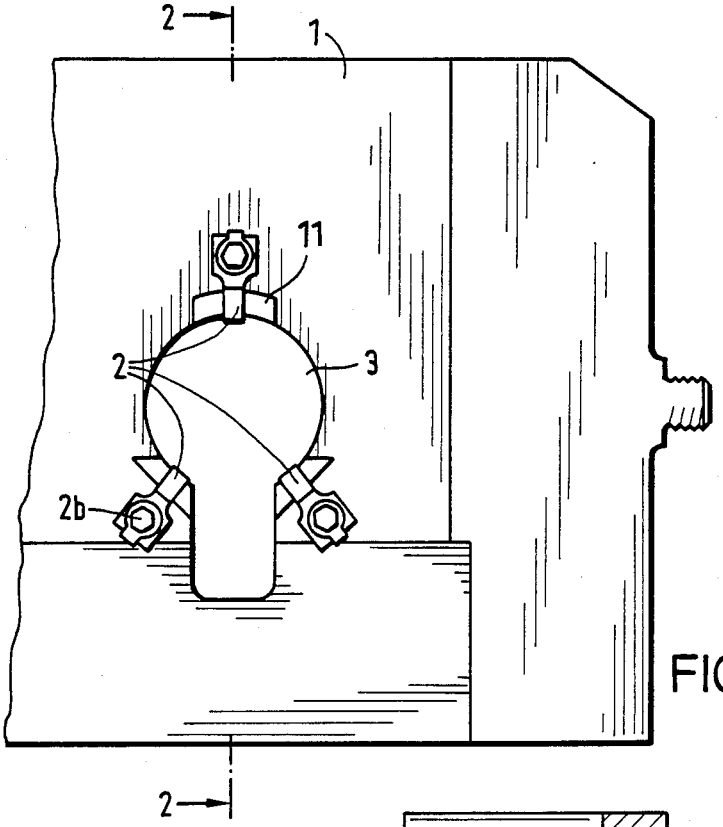
FIG. 1 is a front view of the weapon housing of an automatic cannon having a receiving device according to the present invention.

According to FIG. 1, three such leaf springs 2 are provided, one of these leaf springs 2 lying precisely on section line 2—2, while the other two leaf springs are placed symmetrically to the first, to the right and to the left thereof and offset by about 135° with respect to the first leaf spring 2. The fixed ends of leaf springs 2 are each fastened to weapon housing 1 by means of a screw 2*b*. The free end 2*a* of each leaf spring 2 is bent radially outwardly and projects freely movably into a recess 1*a* provided in weapon housing 1 in such a manner that, if pressure is applied, the free end 2*a* of the leaf spring 2 is able to yield by springing radially outwardly. Every piece of ammunition 4 advancing into cartridge chamber 10*a* of gun barrel 10 must widen the feed opening 3 constricted by leaf springs 2 as they project radially inwardly, i.e., once projectile 4*b* connected with powder body 4*a* has passed leaf springs 2, the powder body 4*a* of the advancing ammunition 4 presses leaf springs 2 radially outwardly. The tensioned leaf springs 2 exert a counterpressure on the outer surface of powder body 4*a* and thus brake the advance of ammunition 4, preventing it from moving ahead of the driving feed finger 5 of the feed mechanism (not shown). This ensures that feed finger 5 is always in force-transmitting contact with the rear face of powder body 4*a* and thus advances the ammunition 4 safely and without damaging impact movements into cartridge chamber 10*a*. Advisably, the local position of leaf springs 2 is selected so that the first contact of powder body 4*a* with leaf springs 2 takes place immediately before the start of the deceleration movement of feed finger 5.

Figure 4:
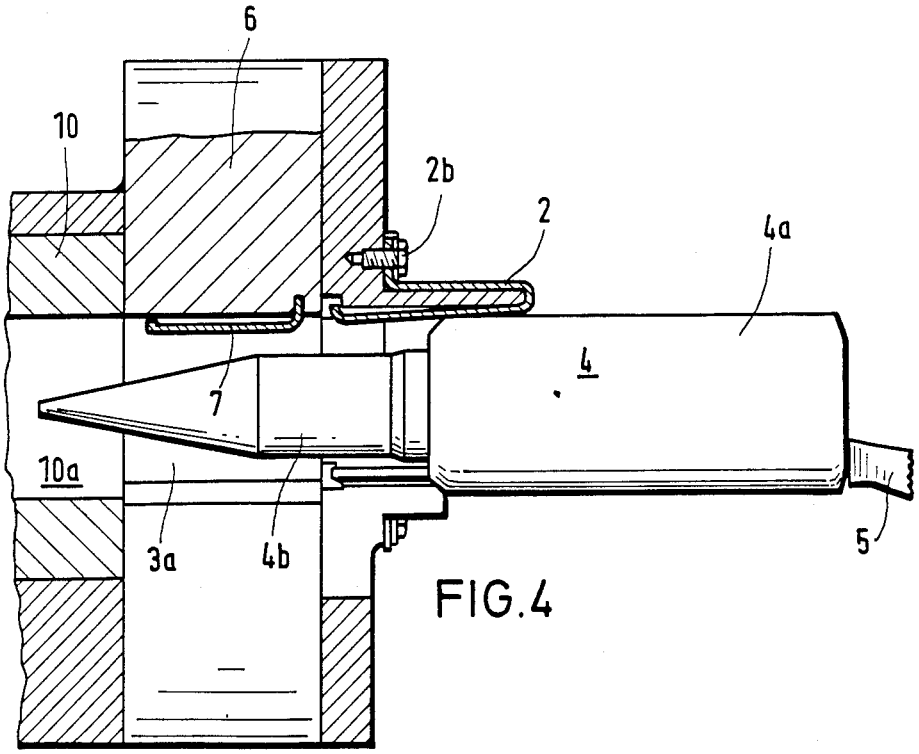
FIG. 4 shows a modification of the invention employing additional spring means in the breech wedge.

In the further embodiment of the invention illustrated in FIG. 4, further leaf springs 7 are provided in feed opening 3*a* which is disposed in the breech wedge 6 itself. These further leaf springs 7 constitute an additional restraint for the ammunition as soon as its powder body 4*a* comes in contact with them. These additional leaf springs 7 reliably prevent recoil movements even at higher feed velocities.

In modification of the invention, the spring paths and/or the spring characteristics of leaf springs 2 and 7 can be dimensioned differently, for example so that the ammunition 4 is initially decelerated only slightly in the region of leaf springs 2 and is then decelerated more in the region of springs 7.

The present disclosure relates to the subject matter disclosed in patent application P 36 18 267.2, filed May 30th, 1986 in the Federal Republic of Germany, the entire specification of this German application being incorporated herein by reference.

It will be understood that the above description of the present invention is susceptible to various modifications, changes and adaptations, and the same are intended to be comprehended within the meaning and range of equivalents of the appended claims.

What is claim is:

1. An automatic cannon for use with a linearly advanced and retracted feed finger that transports caseless ammunition to the cannon, said cannon comprising:

a weapon housing having a feed opening with a periphery, the weapon housing additionally having an interior with a recess therein;

a wedge-type breech block disposed adjacent the weapon housing, the wedge-type breech block having a feed opening;

a gun barrel disposed adjacent the wedge-type breech block, the gun barrel having a cartridge chamber for receiving ammunition transported through the feed opening of the weapon housing and the feed opening of the wedge-type breech block by the feed finger; and receiving means for damping the forward movement of the ammunition into the cartridge chamber, the receiving means including a plurality of leaf springs which are distributed around the periphery of the feed opening of the weapon housing, the leaf springs having free ends which resiliently project inwardly so as to constrict the feed opening of the weapon housing, the free ends of the leaf springs being bent over radially outwardly and being received by the recesses.

2. The automatic cannon of claim 1, wherein the receiving means further comprises at least one additional leaf spring disposed in the feed opening of the wedge-type breech block.

3. The automatic cannon of claim 2, wherein the spring characteristics of the leaf springs are different from the spring characteristics of the at least one additional leaf spring.

4. The automatic cannon of claim 3, wherein each at least one additional leaf spring has a respective free end which projects inwardly, and wherein the inward extension of the free ends of the leaf springs is shaped differently from the inward extension of the free end of each at least one additional leaf spring.

5. The automatic cannon of claim 2, wherein each at least one additional leaf spring has a respective free end which projects inwardly, and wherein the inward extension of the free ends of the leaf springs is shaped differently from the inward extension of the free end of each at least one additional leaf spring.

6. An automatic cannon for use with a linearly advanced and retracted feed finger that transports caseless ammunition to the cannon, said cannon comprising:

a weapon housing having a feed opening with a periphery; a wedge-type breech block disposed adjacent the weapon housing, the wedge-type breech block having a feed opening;

a gun barrel disposed adjacent the wedge-type breech block, the gun barrel having a cartridge chamber for receiving ammunition transported through the feed opening of the weapon housing and the feed opening of the wedge-type breech block by the feed finger;

receiving means for damping the forward movement of the ammunition into the cartridge chamber, the receiving means including a plurality of leaf springs which are distributed around the periphery of the feed opening of the weapon housing, the leaf springs having free ends which resiliently project inwardly so as to constrict the feed opening of the weapon housing, the receiving means further including at least one additional leaf spring disposed in the feed opening of the wedge-type breech block and having a free end which projects inwardly, the spring characteristics of the leaf springs being different from the spring characteristics of the at least one additional leaf spring and the inward extension of the free ends of the leaf springs being shaped differently from the inward extension of the free end of each at least one additional leaf spring.

7. An automatic cannon for use with a linearly advanced and retracted feed finger that transports caseless ammunition to the cannon, said cannon comprising:

a weapon housing having a feed opening with a periphery;

a wedge-type breech block disposed adjacent the weapon housing, the wedge-type breech block having a feed opening;

a gun barrel disposed adjacent the wedge-type breech block, the gun barrel having a cartridge chamber for receiving ammunition transported through the feed opening of the weapon housing and the feed opening of the wedge-type breech block by the feed finger; and receiving means for damping the forward movement of the ammunition into the cartridge chamber, the receiving means including a plurality of leaf springs which are distributed around the periphery of the feed opening of the weapon housing, the leaf springs having free ends which resiliently project inwardly so as to constrict the feed opening of the weapon housing, the receiving means further including at least one additional leaf spring disposed in the feed opening of the wedge-type breech block and having a feed end which projects inwardly, the inward extension of the leaf springs being shaped differently from the inward extension of the at least one additional leaf spring.

* * * * *